United States Patent [19]

Metzger et al.

[11] Patent Number: 4,763,795

[45] Date of Patent: Aug. 16, 1988

[54] DESK TOP CARD FILE SYSTEM

[75] Inventors: Louis G. Metzger, Closter; Richard Davi, Glenwood, both of N.J.

[73] Assignee: Insilco Corporation, Meriden, Conn.

[21] Appl. No.: 896,010

[22] Filed: Aug. 13, 1986

[51] Int. Cl.[4] ..... B42F 17/00

[52] U.S. Cl. ..... 211/11; 211/50

[58] Field of Search ..... 211/11, 50, 51, 42, 211/40, 59.3, 162; 16/337, 341, 342; 248/463, 457; 312/188, 189; 108/129

[56] References Cited

U.S. PATENT DOCUMENTS

| | | | |
|---|---|---|---|
| 47,624 | 5/1865 | Dubernet | 211/50 |
| 838,516 | 12/1906 | Bodinger | 248/463 X |
| 963,327 | 7/1910 | Schmitt | 248/463 |
| 1,055,999 | 3/1913 | Barnett . | |
| 1,389,116 | 8/1921 | Baster . | |
| 1,522,994 | 1/1925 | Amsden . | |
| 2,591,246 | 4/1952 | Everest et al. | 16/337 X |
| 3,106,920 | 10/1963 | Scholfield . | |
| 3,180,493 | 4/1965 | Kipnis . | |
| 3,237,239 | 3/1966 | Rudnick . | |
| 3,589,523 | 6/1971 | Belden . | |
| 3,817,393 | 6/1974 | Neilsen | 211/50 |
| 4,456,128 | 6/1984 | Warshaw | 211/11 |

*Primary Examiner*—J. Franklin Foss
*Assistant Examiner*—Sarah A. Lechok Eley
*Attorney, Agent, or Firm*—Natter & Natter

[57] ABSTRACT

A desk top card file includes an elongate one piece base having an arcuate longitudinal profile. File cards are releasably carried by a pair of parallel longitudinal rails attached to the base. An end plate is hinged to each end of the base. The end plates are movable from a substantially parallel vertical orientation where they compact a stack of cards when the card file is not in use, to an open position, rendering the individual cards accessible for selection and reading. The hinges carry a resilient friction restraint which maintains each end plate at a selected angle. Variable friction forces determined by the profile of cam surfaces of the end plates minimize wear of the friction restraint while maintaining adequate retention forces on the card stack. The file includes a pivotable stand which is mounted to the underside of the base at one end and is opened to tilt the file toward the user. Optionally, the stand attaches to the base along an axis parallel to a side and is pivotable to elevate the side thus enabling the file to be used in a bookwise orientation.

15 Claims, 6 Drawing Sheets

FIG. 2
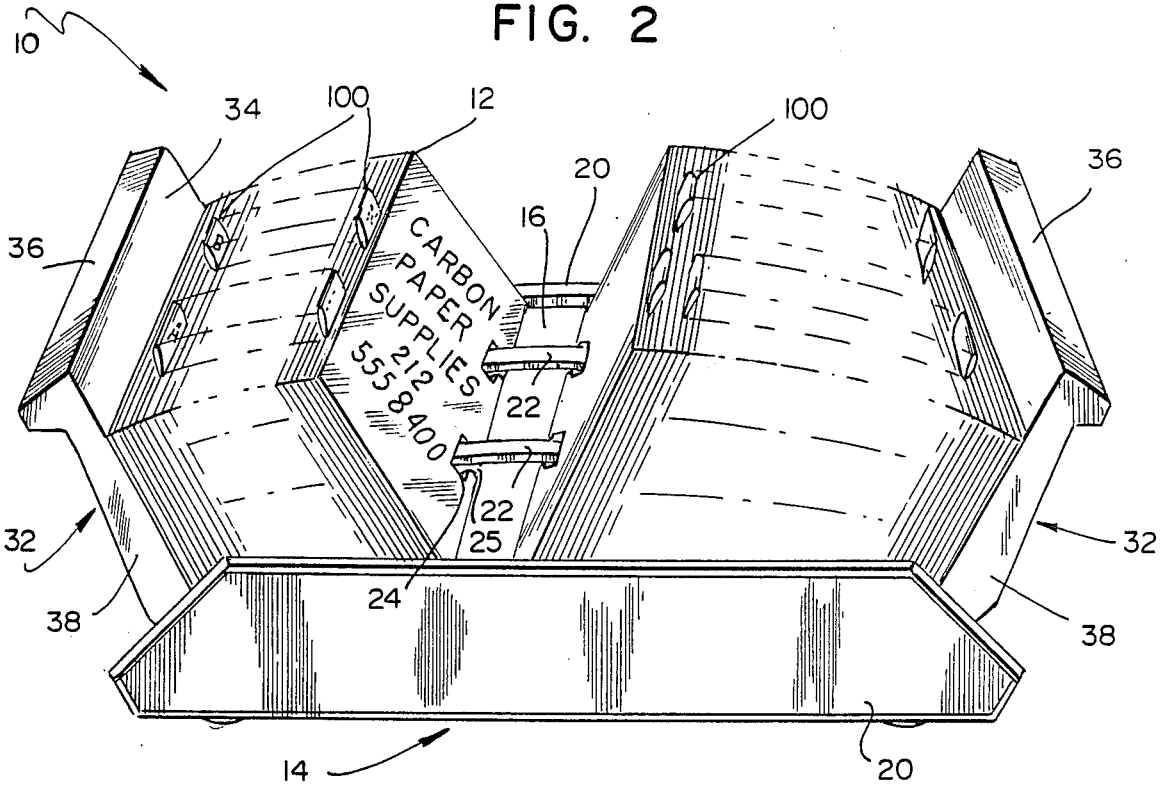
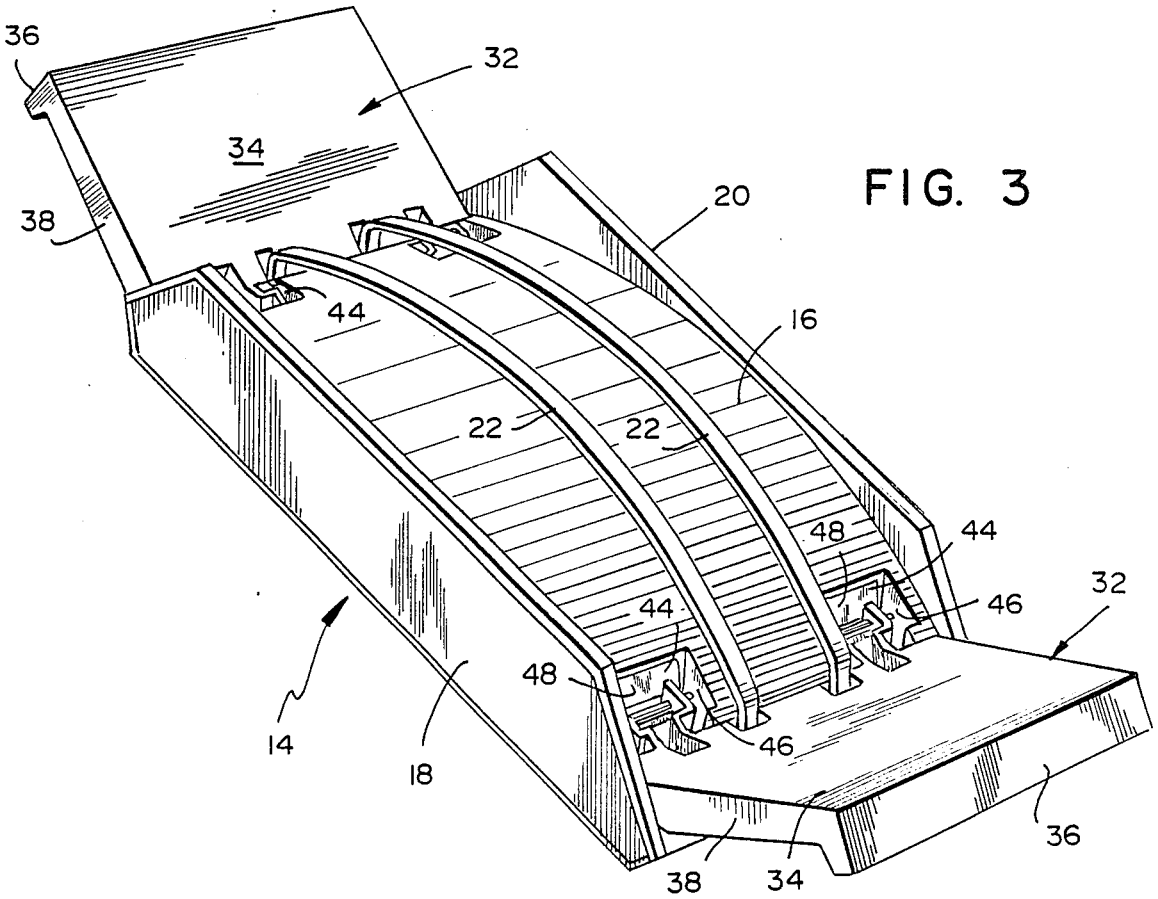
FIG. 3

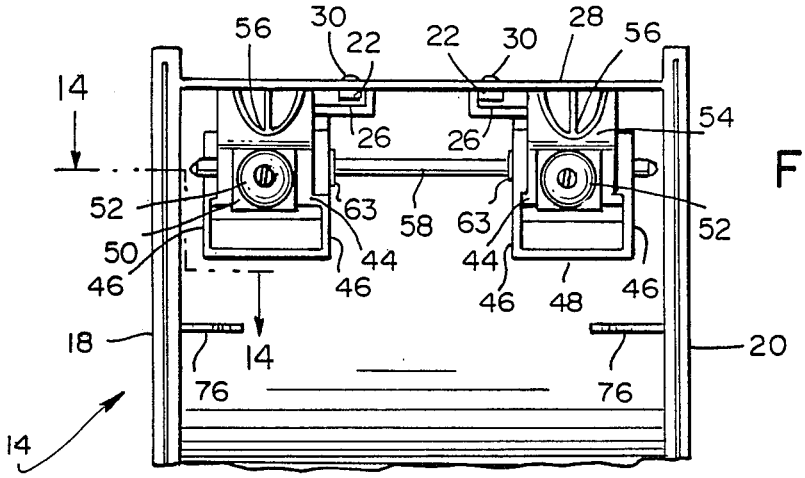
FIG. 7
FIG. 8
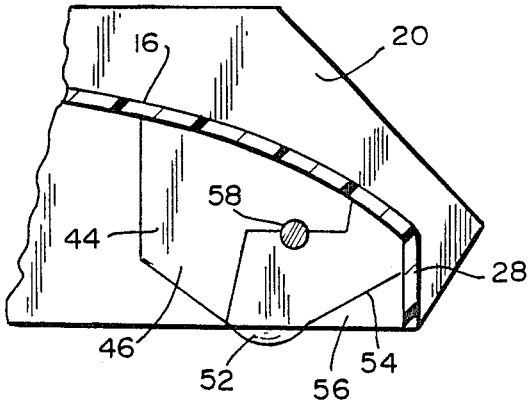
FIG. 9
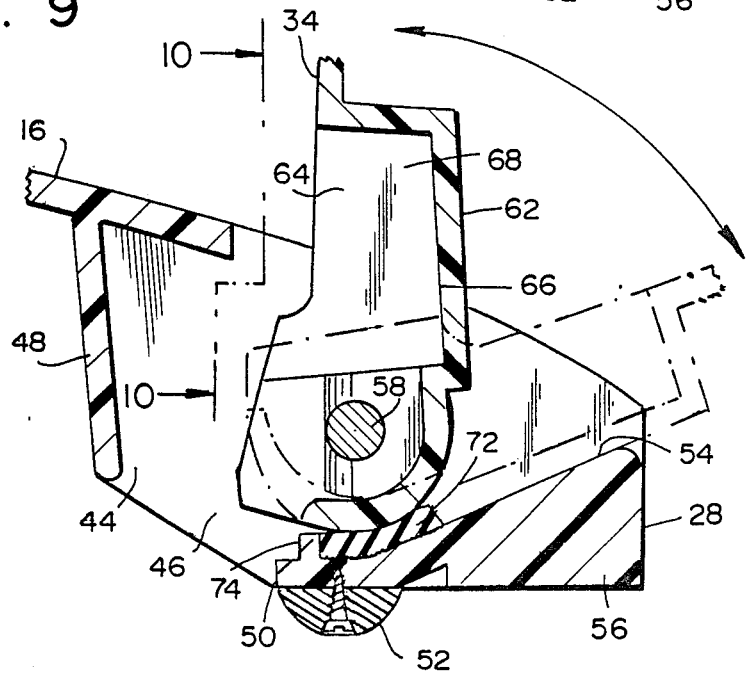

DESK TOP CARD FILE SYSTEM

BACKGROUND OF THE INVENTION

1. Field of the Invention

This invention relates to filing systems generally and more particularly to desk top card files.

2. Brief Description of the Prior Art

Card filing systems have been routinely employed for information storage and retrieval purposes in office environments. Typically card filing systems have been used for storing lists of names, addresses and telephone numbers of accounts, associates and the like.

While computerized information storage and retrieval systems have revolutionized office procedures by enabling information to be stored in machine readable format on a memory device such as a disk, tape or other medium, information retrieval required at least a keyboard and a screen. Such equipment usually occupied more space than a conventional desk top file. Further, the utilization of a terminal to retrieve only an address and/or telephone number, for example, often took more time and skill than that required to obtain such information from an alphabetized card file. In addition, to obtain such information from a memory required diverting computer time from other tasks. As a result of such shortcomings, conventional card filing systems restained popular in the face of advancing office automation through computer technology.

Among the problems encountered with prior card file systems have been the lack of capacity for increased card storage without providing a large card carrying structure. Also, many card file users experienced difficulty in viewing or accessing desired cards when card files did carry cards to capacity. Separation of cards for speedy access of desired information was of paramount significance and prior files lacked the ability and versatility to facilitate such separation when large numbers of cards were carried. Prior card files also lacked the ability to utilize reduced desk top space when not being accessed.

SUMMARY OF THE INVENTION

A desk top card filing system includes a molded plastic one piece base having an arcuate longitudinal profile surface. A pair of rails uniformly spaced from the arcuate base surface, are mounted to opposite ends of the base. A stack of cards carried by the rails is framed between a pair of pivotal end plates hinged to the base. The hinges include wells formed in the base at opposite ends. Each well receives a leg projecting from an end plate. Seated in the well is a compressible elastomer restraint pad. The pad is engaged by a curved peripheral surface of the leg. This leg peripheral surface increases in diameter as the plate is closed. The pad serves to retain the end plate in any selected position and provides maximum retention when the end plates are closed.

A U shaped stand is attachable to a bracket and is mounted to the underside of the base adjacent one end of the card file. The stand is rotatable from a closed position, concealed beneath the base, to an open position, projecting downwardly and elevating one end of the base. Optionally, the stand attaches to a further bracket positioned along an axis parallel to a longitudinal side of the file. When the stand is moved to the open position, the side of the file is tilted up, enabling the file to be used in a bookwise orientation.

From the foregoing compendium, it will be appreciated that a consideration of the present invention is to provide a desk top card file system of the general character described which is not subject to the disadvantages of the background art aforementioned.

An aspect of the present invention is to provide a desk top card file system of general character described which is low in cost and suitable for economic mass production fabrication.

A further consideration of the present invention is to provide a desk top card file system of the general character described which occupies but a modicum of desk space yet provides ready card access for information retrieval.

Another aspect of the present invention is to provide a desk top card file system of the general character described which occupies reduced space when not being utilized for retrieval of information.

A feature of the present invention is to provide a desk top card file system of the general character described which includes a pair of end plates adapted to compress a stack of file cards for storage.

An additional feature of the present invention is to provide a desk top card file system of the general character described which includes a pair of pivotable end plates for a stack of cards and an easy to use end plate retaining system to prevent undesired movement of the plates.

Other aspects, features and considerations of the present invention in part will be obvious and in part will be pointed out hereinafter.

With these ends in view, the invention finds embodiment in various combinations and elements and arrangement of parts by which the said aspects, features and considerations and certain other aspects, features and considerations are attained, all as fully described with reference to the accompanying drawings in the scope which is more particularly pointed out and indicated in the appended claims.

BRIEF DESCRIPTION OF THE DRAWINGS

In the accompanying drawings in which is shown one of the various possible exemplary embodiments of the invention.

FIG. 2 is a perspective illustration of the card file system wherein the stand is mounted to the base in an alternate position elevating a side of the base to present the cards in a bookwise format;

FIG. 3 is a perspective illustration of the card file system without cards for the purpose of better illustrating the components thereof and showing a pair of end plates pivoted to their open position;

FIG. 7 is a fragmentary plan view of the underside of the base and illustrating a pair of wells which receive legs projecting from the plates to provide a hinge, also illustrated is a hinge pin extending through the wells;

FIG. 8 is an enlarged fragmentary sectional view of the card file system, the same being taken substantially along line 8—8 of FIG. 5 and illustrating a side wall of a well;

FIG. 9 is an enlarged fragmentary sectional view through a well and a leg of an end plate, the same being taken substantially along the line 9—9 of FIG. 5 and is showing, in dot and dash lines, the open position of the end plate;

DESCRIPTION OF THE PREFERRED EMBODIMENT

Figure 1:
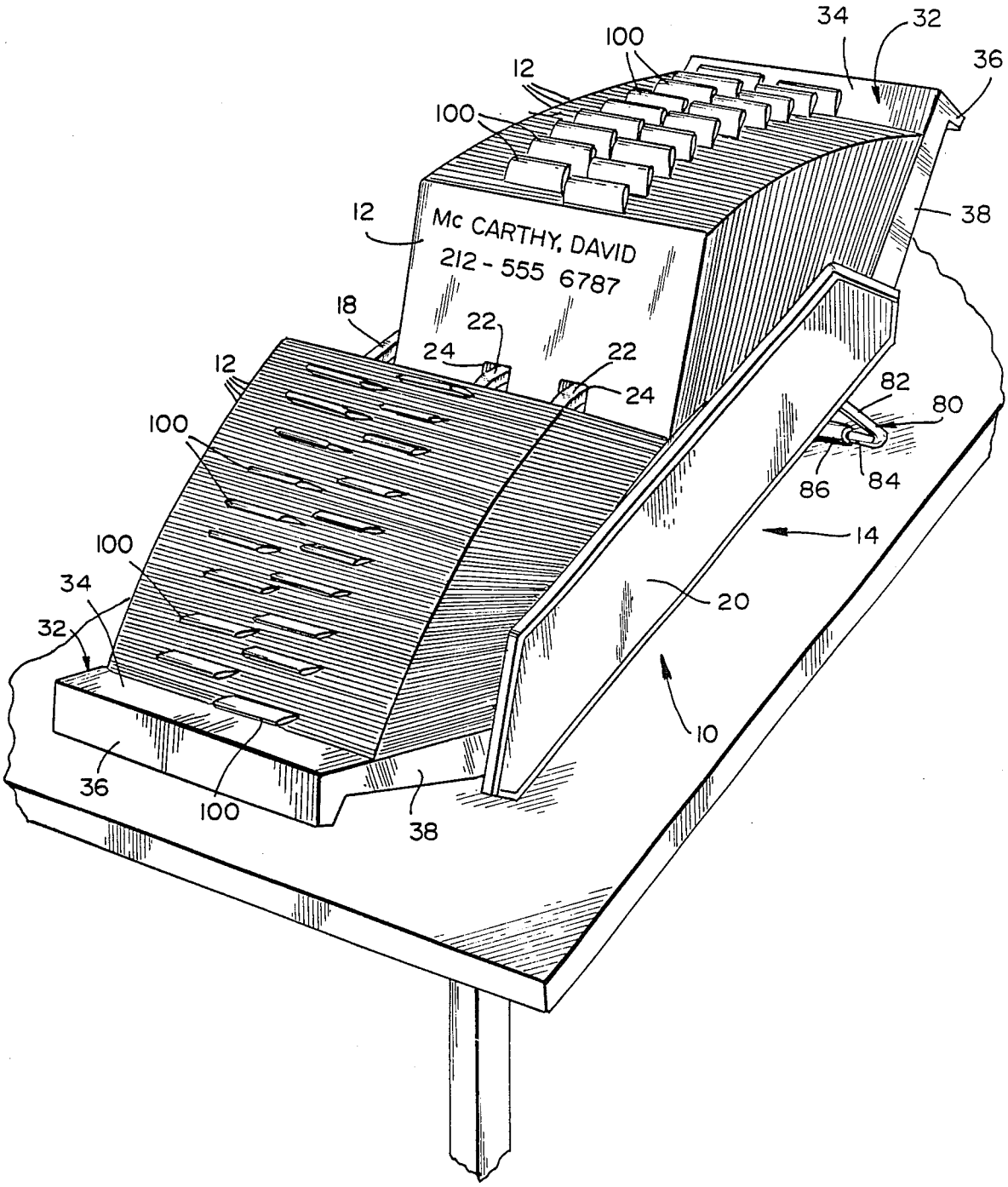
FIG. 1 is a perspective illustration of a desk top card file system constructed in accordance with and embodying the invention and showing a card file base having a pair of rails with a stack of cards mounted to the rails and positioned between a pair of pivotable end plates and with a stand elevating one end of the base.

Referring now in detail to the drawings, the reference numeral 10 denotes generally a desk top card file system constructed in accordance with and embodying the invention. The system 10 is adapted to carry a stack of individual cards 12 upon which information is stored and comprises an overall assemblage for the storage, access and retrieval of such information. As is best illustrated in FIG. 3 wherein the system is shown without cards, the system 10 includes an elongate base 14 preferably molded of one piece plastic construction. The base 14 may be formed of any suitable material such as conventional thermoplastics including acrylonitrile butadiene styrene, acrylics, polycarbonate, polyesters, and polystyrenes. Preferably, the material selected provides sufficient strength, rigidity and resistance to impact for employment in the card file system 10.

The base 14 includes a platen 16 having an arcuate profile. The platen 16 is positioned between a pair of side walls 18, 20 and, as will be hereinafter described, a row of cards 12 is carried above the platen 16 by a pair of rails 22.

The rails 22 may be formed of metal or other suitable material and are preferably curved to be uniformly spaced from the arcuate profile of the platen 16. In addition, as will be observed from FIG. 3, the rails 22 are parallel to one another.

Each rail is bent to provide a depending vertical leg adjacent its ends. The legs extend through apertures 26 formed at the end of the platen 16 and abut the inside of a vertical skirt 28 which is provided as a continuation of the arcuate platen 16. A suitable fastening device such as a rivet 30 extends through registered apertures in each rail leg and the skirt to secure the rails. It should be noted that the side walls of the apertures 26 abut the edges of the rail to prevent rotation of the rails about their rivets.

The cards 12 are of conventional configuration and include a pair of rectangular cut outs 24 through which the rails 22 extend. The cards are inserted on the rails or removed therefrom by an open neck 25 which extends from the cut outs 24 to the lower edge of the card.

Figure 4:
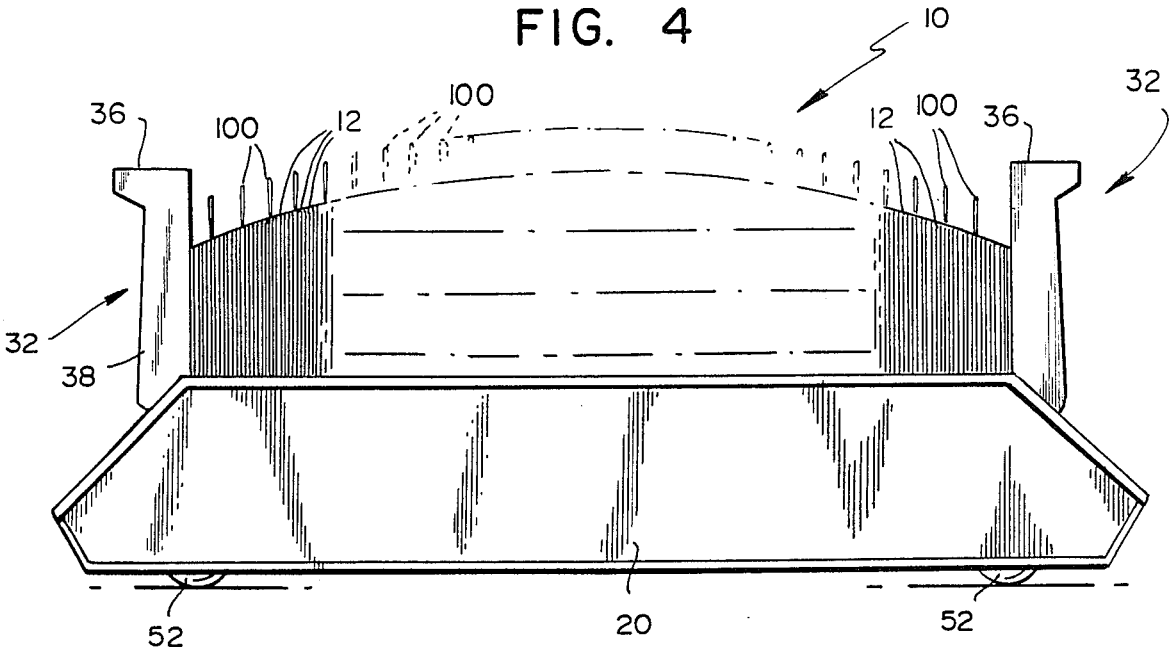
FIG. 4 is a side elevational view of the card file system with the end plates pivoted to their closed position, compacting the stack of cards.

An end plate 32 is pivotally hinged to the base 14 adjacent each end thereof. In accordance with the invention, the end plates 32 are pivotable from an open position, illustrated in FIGS. 1 and 3 to a closed position, compacting the cards 12 against one another in substantially vertical orientation as illustrated in FIG. 4. An intermediate position of the end plates 32 is illustrated in FIG. 2.

The end plates 32 include a substantially flat planar interior face 34 and a plurality of intergral flanges which project outwardly toward the ends of the base 14. The flanges provide an upper lip 36 for grasping the end plates, allowing the card file system to be carried from one location to another, side walls 38, and a lower lip 40 to strengthen the structure. It should be noted that in order to preclude interference between the end plates 32 and the rails 22, the bottom edges of the end plates 32 include appropriate notches 42 through which the rails 22 extend.

Each of the end plates 32 is pivotally secured to the base 14 by a hinge structure to be hereinafter described. The hinge structure includes a pair of wells 44 formed in the platen 16 and skirt 28 adjacent each of the ends of the platen. The wells 44 include a pair of substantially vertical side walls 46, a rear wall 48, and a bottom wall 50. A resilient desk top engaging pad 52 is secured to the bottom wall 50 by suitable means such as a screw. From an observation of FIGS. 7 and 9 it will be appreciated that a portion of the rear wall 48 and bottom wall 50 are open.

In addition, it should be noted that the bottom wall includes an upwardly sloping area 54 which is reinforced by an E-shaped (see FIG. 7) gusset 56 extending between the area 54 and the skirt 28. Further it should be realized that the side walls 46 include upper and lower portions which are spaced apart differently, the lower wall portions being spaced apart a greater distance than the upper. A transition line extends through the hinge axis as illustrated in FIG. 8.

Figure 14:
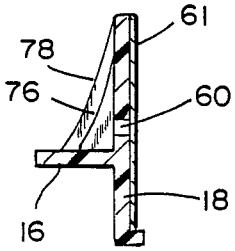
FIG. 14 is a fragmentary enlarged sectional view through a portion of the base, the same being taken substantially along the line 14—14 of FIG. 7 and illustrating an assembly aperture in the base and a pair of gussetts.

In accordance with the invention, registered apertures are provided through the side walls 46 of both wells 44 at each end of the base. Through the apertures, a hinge pin 58 is inserted. To access the well apertures, a further registered apperture 60 is provided in at least one of the side walls 18 as illustrated in FIG. 14. The side wall aperture 60 may be concealed by a decorative adhesive backed layer 61 while the hinge pin is restrained against axial movement by a pair of clips 63.

Figure 10:
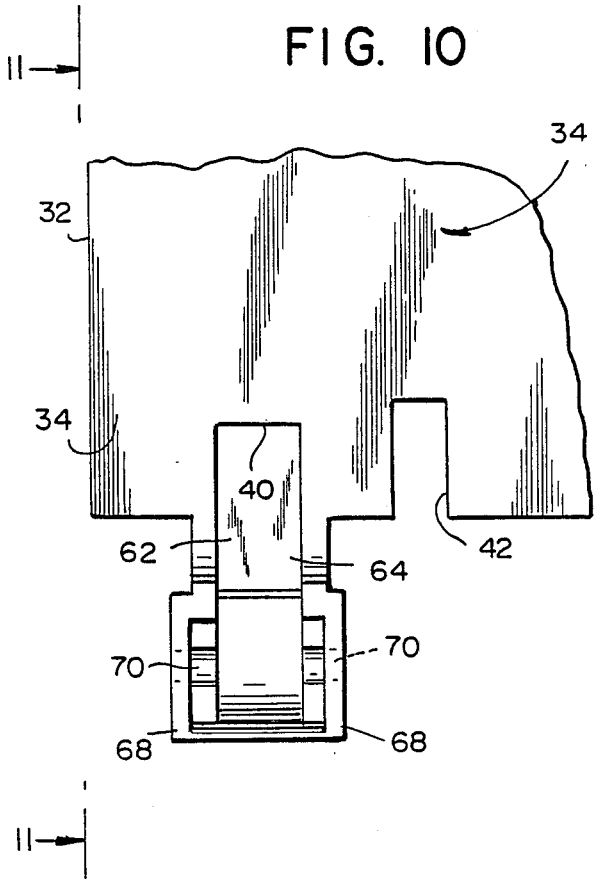
FIG. 10 is a slightly reduced scale fragmentary auxiliary view of the inner face of an end plate, the same being taken substantially along the line 10—10 of FIG. 9.
Figure 11:
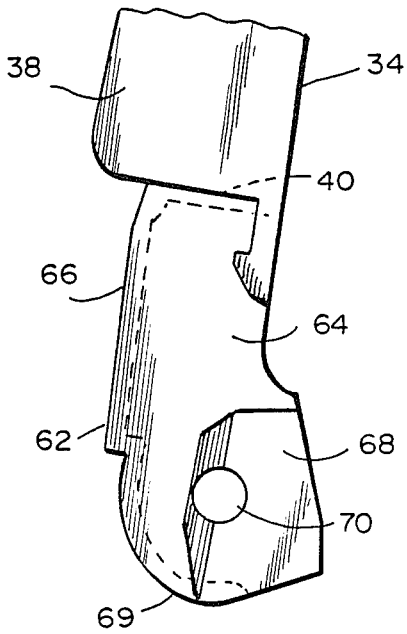
FIG. 11 is an enlarged fragmentary auxiliary elevaticnal view of an end plate, the same being taken substantially along the line 11—11 of FIG. 10.
Figure 5:
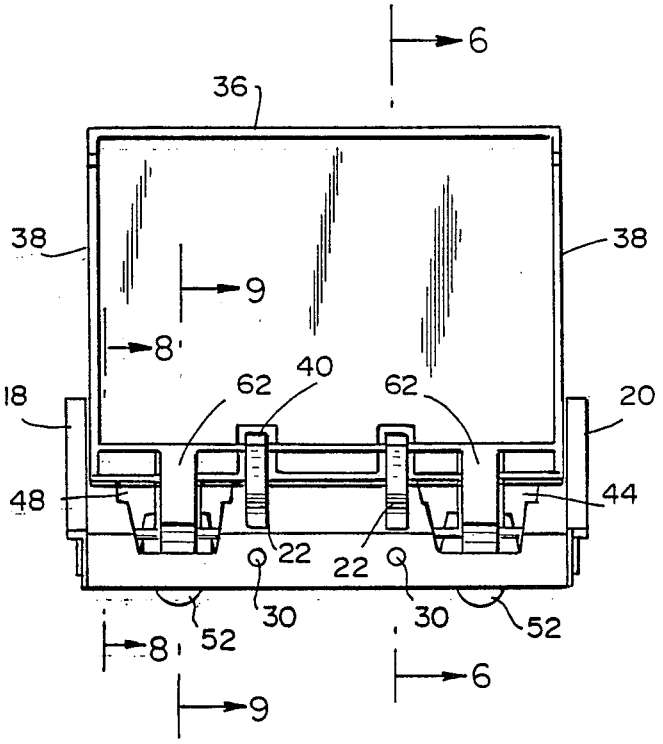
FIG. 5 is an end view of the card file system as illustrated in FIG. 4.
Figure 6:
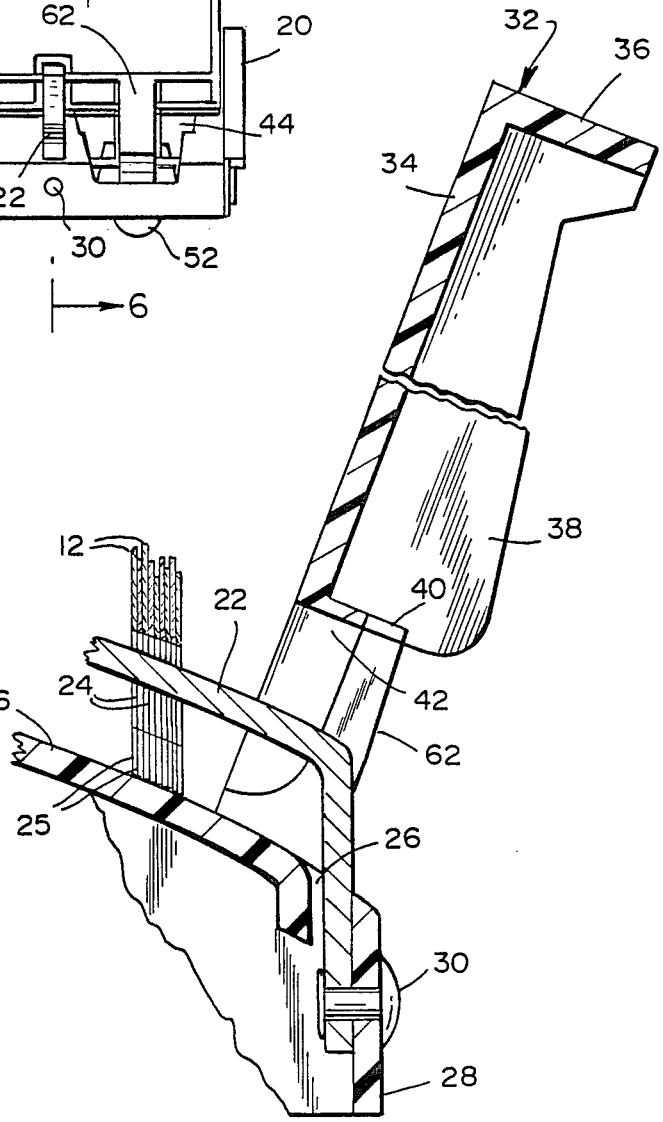
FIG. 6 is an enlarged fragmentary sectional view through the card file system, the same being taken susbtantially along the line 6—6 of FIG. 5 except, however, the end plate has been rotated approximately 20° from its closed position and illustrating the manner in which a rail is mounted to the base.

Each end plate 32 includes a pair of depending legs 62 which extend into mating wells 44. From an examination of FIGS. 10 and 11 it will be seen that each leg comprises a downward extension of the end plate 32. The leg 62 extends from the face side 34 of the end plate toward the outer ends of the base and includes a bucket or cavity 64 having a top wall formed by a portion of the lower lip 40, a rear wall 66 and a pair of side walls 68. Like the side wall of the well 44, the leg side walls 68 include portions spaced apart differently. Specifically, the bucket 64 is enlarged adjacent its lower end. An aperture 70 for receiving the hinge pin 58 extends through the side walls 68. It should be noted that the lower peripheral surface 69 of the leg 62 is arcuately configured about the center of the aperture 70. In accordance with the invention, the leg periphery is curved in a spiral rather than a circular pattern to provide a cam-like engagement with an elastomeric resilient friction restraint pad 72.

Referring now to FIG. 9, it will be seen that the resilient pad 72 is positioned on the upper horizontal surface of the bottom wall 50 and the upper surface of the upwardly sloped area 54 of the bottom wall. The pad 72 may be secured by a suitable adhesive and is positioned to abut against a stop ridge 74 which projects upwardly from the bottom wall 50. The pad 72 is formed of a natural or synthetic elastomer having a desired coefficient of friction and resiliency. The pad 72 may be selected of a material which encompasses a suitable hardness such as 70 durometer.

As mentioned, lower curved peripheral surface 69 of each leg 62 is configured in a spiral rather than a circular pattern about the hinge pin. As a result, when the end plate 32 is in its closed, substantially vertical position, as shown in the solid lines of FIG. 9, the outer periphery in contact with the resilient pad 72 is at its maximum diameter. This results in a substantial compression of the resilient pad, in the order of, for example, 0.015 to 0.020 inches (0.37 to 0.51 mm). The pad 72 thus serves to restrain pivotal movement of the end plate 32 against the outward force of the stack of compacted cards 12. The pad provides maximum restraint force when the end plate is in its vertical position and gradually diminishing restraint forces as the end plate is swung in its open position. This provides proper retention forces where needed and also minimizes wear and abrasion of the friction pad 72.

As the end plate 32 is rotated toward its open position, the periphery of the leg in contact with the resilient pad 72 is of reduced diameter. As a result, the resilient pad is compressed to a lesser extent. Since the outward force of the stack of cards 12 is now less than that when the end plate was in its vertical position, the reduced restraintive force of the pad 72 against the curved surface of the leg is sufficient to prevent movement of the end plate.

In the fully opened position of the end plate 32, shown in dot and dash lines in FIG. 9, the rear wall 66 of the leg 62 abuts against the upper surface of the upwardly sloped area 54 to provide a suitable stop. It should also be appreciated that a jog is provided between the curved periphery at the lower end of the leg 62 and the rear wall 66. It will be seen that the jog accommodates the thickness of the resilient pad so that the pad is not under significant compression when the end plate 32 is fully opened.

To reinforce the base structure, a plurality of web-like gussetts 76, 78 are provided on the underside of the base 14. The gussetts 76, 78 extend between the underside of the platen 16 and the side walls 18, 20.

Figure 12:
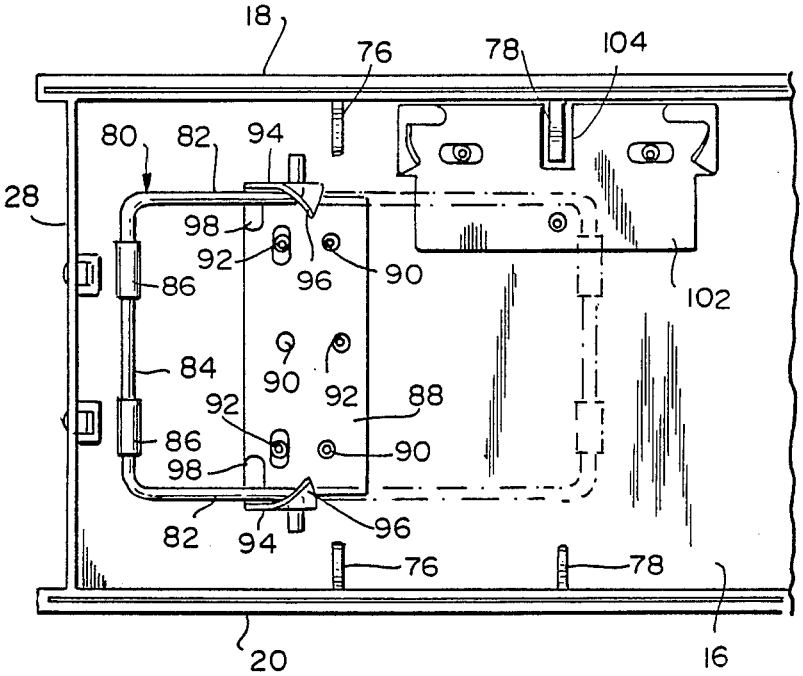
FIG. 12 is a fragmentary plan view of the underside of the card file system with the wells and hinge pin being omitted for clarity and illustrating a U shaped stand and a mounting bracket, the stand being illustrated in its open position for elevating an end of the card file system and showing, in dotted lines, the closed position thereof.

As previously mentioned, the desk top card file system 10 has been illustrated in FIG. 1 in an orientation with its end furthest from the user being elevated so that the forward end is tilted toward the user. For such purpose, a U shaped stand 80 is provided. The stand 80 is depicted in FIG. 12. It should be noted that the underside of the base 14 as illustrated in FIG. 12, does not include the well 44 and other components of the hinge. This is merely for the purpose of better illustrating the stand mechanism and does not reflect the actual appearance of the base.

The stand 80 comprises a U shaped bail having a pair of parallel legs 82 and a bight 84. The free ends of the legs 82 are bent in diverging directions to provide a pivot axle. Tubular cushions 86 may be slipped over the bight 84 to protect a desk top or other supporting surface.

The stand 80 is carried by a metal bracket 88, secured to the underside of the platen 16 with a plurality of rivets 90 or like fasteners. A plurality of locating pins 92, projecting downwardly from the underside of the platen 16, extend through suitable openings in the bracket. The bracket 88 includes a pair of substantially parallel depending side walls 94. The side wall 94 include apertures through which the diverging ends of the legs 82 extend. In addition, each side wall 94 includes a cam surface 96.

In FIG. 12, the stand 80 is illustrated fixed in its open position by the outward pressure of the legs 82 which engage the cam surfaces 96 to force the stand 80 toward the left (as viewed from FIG. 12). The legs 82 abut a pair of horizontal stops 98.

In order to lower the stand, a user merely rotates the bail toward the right as viewed from FIG. 12, to the position indicated in dotted lines. As the stand 80 rotates, the legs 82 compress toward one another due to engagement with the cam surfaces 96. After the legs 82 pass an apex of the cam surface, the cam surface is configured with an opposite slope, and the outward spring force of the legs 82 urge the stand 80 toward the dotted line position.

With the stand 80 in its open position, the cards carried on the base 14 can be easily accessed and viewed by a user once the end plates 32 are opened. The stand in the open position provides the greatest visibility to the user in view of the forward tilted curvature of the platen profile.

It may also be pointed out that a plurality of plastic index sleeves 100 are provided to simplify accessing the cards 12. The index sleeves 100 may be fastened to divider cards 12 or plastic divider elements having cut outs identical to the cut outs 24 for mounting on the rails 22. The index sleeves 100 will carry suitable indexing reference indicia such as alphabet letters or other designations As previously mentioned, the desk top card file system 10 of the present invention is also adapted to be utilized and viewed in a bookwise format. Such format is generally illustrated in FIG. 2. It will be noted from an examination thereof that indicia may be entered on the cards 12 along an axis perpendicular to the card length, similar to that of printing on pages of a book. If utilized in such format the printed reference indicia which are carried in the index sleeves 100 will also be oriented in the same axis. In order to promote maximum viewing versatility, the stand 80 is also adapted to be utilized for tilting the card file system 10 in an easel-like bookwise manner when utilizing this format.

Figure 13:
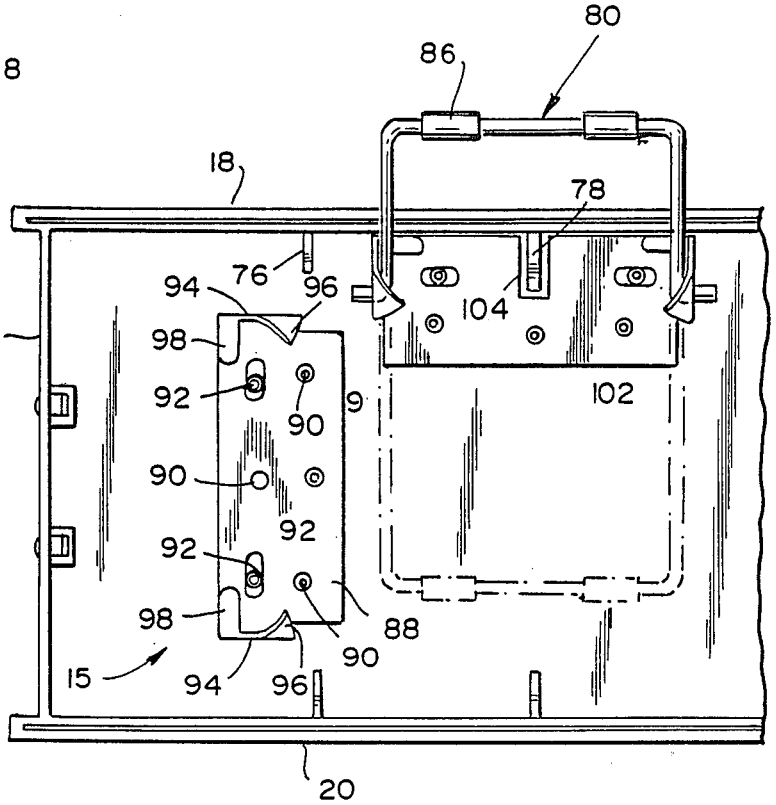
FIG. 13 is a fragmentary plan view of the underside of the base as shown in FIG. 12 with the wells and hinge pin deleted and showing the stand engaged in an alternate bracket for elevating a side of the card file system to utilize the card file system in a bookwise orientation.

Turning now to FIG. 13, wherein the hinge wells 44 and hinge structure have also been omitted for clarity, it will be seen that the stand 80 is therein illustrated as being carried by a bracket 102. The bracket 102 is substantially identical to the bracket 88 previously described except, however, it includes a notch 104 for accommodating the gussett 78. It is secured to the underside to the platen 16 in a manner identical to that of the bracket 88 and is mounted therein adjacent the base side wall 18.

To engage the stand 80 in the bracket 102, the stand is removed from the bracket 88 by forcing the legs 82 toward one anoter until the outwardly bent free ends of the legs are disengaged from the apertures in the side walls 94 of the bracket 88. Thereafter, the legs 82 are urged toward one another, and are registered with and inserted into apertures in the side wall of the bracket 102. Operation between opened and closed positions of the stand 80 with respect to the bracket 102 is identical to that with respect to the bracket 88.

The stand 80 may be engaged in either bracket 88, 102. When in its open position, it tilts the distal surface of the desk top card file system 10 upwardly from the supporting surface to provide easy access to the file cards 12. Whether or not the stand is opened is, of course, at the option of the user. Personal preferences and comfort factors including the user's height, field of view and position of the desk card file system relative to the user affect such determination. Thus, individual preferences in terms of viewing angel and the like may readily be accommodated pursuant to the present invention by virtue of the adaptability of the desk top card file system 10 to provide for adjustments in viewing angle and orientation through selective utilization of the stand 80.

In addition, the end plates 32 permit the stack of file cards to be compacted so that the file system 10 can remain on user's desk when not in use and occupy but a minimum amount of valuable space. In their closed position, the end plates 32 are restrained due to the maximum friction forces generated by the compression of the resilient pads 72. It should be noted that no additional or further locking device need be employed. Undue wear on the resilient pads 72 is avoided due to the gradual cam engagements of the leg periphery against the pad.

As previously discussed, the end plates may be moved to any position between the fully closed and fully opened extreme positions to provide optimum spread of the file cards 12 thus providing a field of view and card exposure to meet the individual preferences and requirements of a user. Some users may prefer to open the end plates to a fully opened position and grasp a plurality of cards and thumb through such cards while other users may prefer less extreme positions of the end plates.

Thus, it will be seen that there is provided a desk top card file system which achieves the various features, aspects and considerations of the present invention which is well suited to meet the conditions of practical usage.

As various changes might be made in the desk top card file system as above set forth, it is to be understood that all matter herein described, described or shown in the accompanying drawings, is to be interpreted as illustrative and not in the limiting sense.

Having thus described the invention, it is claimed as new and desired to be secured by letters patent:

1. A desk top card file system for storage and access of data on a plurality of file cards, the system comprising a base, the base including means for carrying a plurality of file cards in a stack, means framing the stack of cards, the framing means including a pair of end plate means, each end plate means being adapted to engage one of the ends of the stack of cards, hinge means for rotatably mounting the end plate means to the base, the end plate means being rotatable about the hinge means from a fully open position wherein the cards may be separated to provide appropriate spacing for locating a file card having the desired data thereon and to provide a proper viewing angle for examining a selected file card and accessing stored data contained thereon to a closed position wherein the end plate means compact the stack of cards, the stack of cards exerting an outward force against the end plate means when compacted, and means for retaining the end plate means in their closed position whereby the card file system occupies but a minimum amount of space when not being used, said means for retaining the end plate means in their closed position further including a restraint friction pad, the hinge means including a first hinge portion which moves with the end plate means and a second hinge portion which is fixed with respect to the base, means fixing the restraint pad relative to one of the hinge portions, the restraint pad being engaged and compressed by the other hinge portion when the end plate means is in its closed position, the compressed restraint pad frictionally gripping the other hinge portion to retain both hinge portions in their relative positions thereby maintaining the stack of cards in a compressed state.

2. A desk top card file system constructed in accordance with claim 1 wherein the base is elongate, the framing means including a pair of side walls projecting from opposite sides of the base, the stack of cards being positioned between the walls.

3. A desk top card file system constructed in accordance with claim 1 wherein the means for carrying the plurality of file cards in a stack includes a pair of rails and means for mounting the rails above the base.

4. A desk top card file system constructed in accordance with claim 3 wherein the base is formed of a curved arcuate profile, the pair of rails being correspondingly curved and uniformly spaced from the base.

5. A desk top card file system constructed in accordance with claim 1 wherein the end plate means may be rotated to a selected position intermediate the fully opened position and the closed position, the restraint pad being engaged and compressed by the other hinge portion when the end plate means is rotated to the selected position intermediate the fully open position and the closed position, the restraint pad frictionally gripping the other hinge portion to retain the end plate means in its selected intermediate position.

6. A desk top card file system constructed in accordance with claim 5 wherein the stack of cards exerts a maximum outward force against the end plate means when the end plate means are in their closed position, a minimum outward force when the end plate means are in their fully open position and a graduated reduced outward force as the end plate means are moved between the closed position and the fully opened position, the hinge means including means for providing a correspondingly graduated compressive force against the restraint pad by the other hinge portion, the correspondingly graduated compressive force providing a graduated frictionally gripping force between the restraint pad and the other hinge portion sufficient to retain the hinge portion in its selected position and to minimize wear of the restraint pad.

7. A desk top card file system constructed in accordance with claim 6 wherein the means for providing a correspondingly graduated ompressive force against the restraint pad includes camming means associated with the hinge portions.

8. A desk top card file system constructed in accordance with claim 7 wherein the camming means is associated with the other hinge portion.

9. A desk top card file system constructed in accordance with claim 7 wherein the hinge means includes means forming a well in the base, means forming a leg projecting from the end plate means, the leg being received in the well, a hinge pin extending through the well and the leg, the leg including the first hinge portion and the well including the second hinge portion.

10. A desk top card file system constructed in accordance with claim 8 wherein the camming means includes means forming a cam surface on the other hinge portion.

11. A desk top card file system constructed in accordance with claim 1 futher including user access means, the user access means including means for selectively elevating a portion of the base above a supporting surface to tilt the card file system toward a user, the means for selectively elevating a portion of the base comprising a stand for engaging the supporting surface and a pair of bracket means, the stand being seletively carried by either bracket means, the stand rotatively engaging either bracket means, each bracket means including cam means for maintaning the stand in an open position wherein the stand engages the supporting surface to a closed position wherein the stand is concealed benath the base, one of the bracket means being mounted to the base adjacnt an end of the base, and the other bracket means being mounted to the base adjacent a side of the base, the stand engaging either the one bracket whereby an end of the base may be elevated or the other bracket whereby the side of the base may be elevated.

12. A desk top card file system constructed in accordance with claim 11 werein the stand engages each bracket for rotation about an axis, the axes of the pair of brackets being perpendicular to one another.

13. A desk top card file system constructed in accordance with claim 12 wherein the bottom edges of the cards in the stack are substantially parllel to one another, the axis of the stand when engaging the one bracket means being parallel to the bottom edges of the cards and the axis of the stand when engaging the other bracket means being perpendicular to the bottom edges of the cards.

14. A desk top card file system for storage and access of data on a plurality of file cards, the system comprising a base, the base including means for carrying a plurality of file cards in a stack, means framing the stack of cards, the framing means including a pair of end plate means, means rotatably mounting the end plate means to the base, each end plate means being adapted to engage one of the ends of the stakc of cards, said stack of cards exerting a maximum outward force against the end plate means when the end plates means are in a closed position, a minimum outward force when the end plate means are in a fully open position and a graduated reduced outward force against the end plate means as the end plate means are moved between the closed position and the fully open position, and means for retaining said end plate means including means for generating a variable frictional restraint against said respective stack forces that provides a graduated frictional retaintive force against movement of said respective end plates in any corresponding intermediate position between said open and said closed positions, said means for generating including means for varying the retaintive force as a function of the position of the end plate means to the base.

15. In a desk top card file system for storage and access of data on a plurality of file cards comprising a base for supporting a stack of file cards and means for framing said stack of cards including a pair of end plates, each respectively carried upon said base and engaging respective ends of said stack, said end plates being movable for opening and closing said stack, the improvement comprising means defining a graduated frictional restraint disposed between said base and each respective end plate for forcibly maintaining each respective end plate in an open or closed position, and any intermediate position therebetween the defining means including means for varying the degree of frictional restraint as a function of the position of the end plates relative to the base.

* * * * *